US009066598B1

(12) United States Patent
Sears

(10) Patent No.: US 9,066,598 B1
(45) Date of Patent: Jun. 30, 2015

(54) FOOT SUPPORT AND PROTECTION SYSTEM

(71) Applicant: James Jay Sears, Goodrich, MI (US)

(72) Inventor: James Jay Sears, Goodrich, MI (US)

( * ) Notice: Subject to any disclaimer, the term of this patent is extended or adjusted under 35 U.S.C. 154(b) by 0 days.

(21) Appl. No.: 13/959,025

(22) Filed: Aug. 5, 2013

(51) Int. Cl.

| | |
|---|---|
| ***A47C 16/02*** | (2006.01) |
| ***A47C 20/00*** | (2006.01) |
| ***A61G 7/075*** | (2006.01) |
| *A47C 20/02* | (2006.01) |
| *A61G 13/12* | (2006.01) |

(52) U.S. Cl.
CPC ..... *A47C 16/02* (2013.01); *A47C 20/02* (2013.01); *A47C 20/021* (2013.01); *A47C 20/00* (2013.01); *A47C 20/022* (2013.01); *A61G 7/0755* (2013.01); *A61G 13/1245* (2013.01); *A61G 13/125* (2013.01)

(58) Field of Classification Search
CPC ..... A47C 16/02; A47C 20/02; A47C 20/021; A47C 20/00; A47C 20/022; A61G 7/0755; A61G 13/1245; A61G 13/125
USPC ..... 5/648, 651, 624, 630, 650
See application file for complete search history.

(56) References Cited

U.S. PATENT DOCUMENTS

| | | | | |
|---|---|---|---|---|
| 1,547,879 | A | | 7/1925 | Lambert |
| 2,160,443 | A | | 5/1939 | Schadell |
| 2,210,255 | A | | 8/1940 | Peevey |
| 2,356,219 | A | | 8/1944 | Coffing |
| 2,398,731 | A | | 4/1946 | Voss |
| 2,401,999 | A | | 6/1946 | Wolfe |
| 2,478,497 | A | | 6/1946 | Morrison |
| 2,595,449 | A | | 5/1952 | Coffing et al. |
| 2,598,295 | A | | 5/1952 | Pelton |
| 2,611,139 | A | | 9/1952 | Ecklund |
| 2,642,589 | A | | 6/1953 | Cobb |
| 2,676,340 | A | | 4/1954 | Garriott et al. |
| 2,911,657 | A | | 11/1959 | Streeter, III |
| 2,960,151 | A | | 11/1960 | Fairgrieve |
| 2,974,328 | A | | 3/1961 | Hebberd |
| 3,050,747 | A | | 8/1962 | Uhl |
| 3,173,157 | A | * | 3/1965 | Maples ..... 5/651 |
| 3,333,286 | A | | 8/1967 | Biolik |
| 3,511,233 | A | | 5/1970 | Holy, Jr. |
| 3,639,927 | A | | 2/1972 | Munch |
| 3,644,949 | A | | 2/1972 | Diamond |
| 3,742,528 | A | | 7/1973 | Munch |
| 3,803,645 | A | | 4/1974 | Oliverius |
| 3,808,614 | A | | 5/1974 | Reinhard |
| 4,278,079 | A | | 7/1981 | Simhoni et al. |
| 4,829,615 | A | | 5/1989 | Raymond |
| 5,111,808 | A | | 5/1992 | Meals |
| 5,203,042 | A | | 4/1993 | Mason |

(Continued)

*Primary Examiner* — Peter M Cuomo
*Assistant Examiner* — Brittany Wilson
(74) *Attorney, Agent, or Firm* — Larry E. Henneman, Jr.; Grefory P. Gibson; Henneman & Associates, PLC

(57) ABSTRACT

A novel foot support device includes a first sidewall adapted to engage the lateral side of a first foot, a second sidewall adapted to engage the lateral side of a second foot, and a backwall adapted to engage both the plantar region of the first foot and the plantar region of the second foot. In a particular embodiment, the first sidewall includes an inclined interior surface, the second sidewall includes an inclined interior surface, and the backwall includes an inclined interior surface. In another particular embodiment, the foot support device includes two discrete regions, one of which engages a user's left foot and the other of which engages the user's right foot.

40 Claims, 7 Drawing Sheets

(56) References Cited

U.S. PATENT DOCUMENTS

| | | | |
|---|---|---|---|
| 5,226,245 | A | 7/1993 | Lamont |
| 5,329,941 | A | 7/1994 | Bodine, Jr. |
| 5,360,017 | A | 11/1994 | Austin |
| 5,433,505 | A | 7/1995 | Coyne et al. |
| D373,422 | S | 9/1996 | Adams |
| 5,584,303 | A | 12/1996 | Walle |
| 5,603,336 | A | 2/1997 | Shepich |
| 5,673,447 | A | 10/1997 | White et al. |
| 5,725,486 | A | 3/1998 | Engelman |
| 5,745,939 | A | 5/1998 | Flick et al. |
| 5,827,211 | A | 10/1998 | Sellinger |
| 5,978,991 | A | 11/1999 | Miles |
| 6,182,314 | B1 | 2/2001 | Frydman |
| 6,240,581 | B1 | 6/2001 | Pender |
| 6,260,221 | B1 | 7/2001 | Grabell et al. |
| 6,345,401 | B1 | 2/2002 | Frydman |
| 6,442,779 | B1 | 9/2002 | LeVert et al. |
| 6,490,742 | B2 | 12/2002 | Hall et al. |
| 6,640,810 | B1 | 11/2003 | Callsen et al. |
| 6,895,615 | B2 | 5/2005 | Dilascio |
| 6,901,616 | B1 | 6/2005 | Warrington et al. |
| 7,137,159 | B1 | 11/2006 | Choate |
| 7,281,282 | B2 | 10/2007 | Huber |
| 7,421,749 | B2 | 9/2008 | Herschel |
| 7,555,795 | B1 | 7/2009 | Feil |
| 8,302,985 | B2 * | 11/2012 | Ruby ..... 280/304.1 |
| 2001/0027577 | A1 | 10/2001 | Frydman |
| 2002/0095731 | A1 | 7/2002 | Hall et al. |
| 2003/0229942 | A1 | 12/2003 | Dilascio |
| 2005/0273931 | A1 | 12/2005 | Edwards |
| 2006/0248647 | A1 | 11/2006 | Huber |

* cited by examiner

FOOT SUPPORT AND PROTECTION SYSTEM

BACKGROUND OF THE INVENTION

1. Field of the Invention

This invention relates generally to medical devices, and more particularly to a device for supporting and protecting feet.

2. Description of the Background Art

It is common for people to suffer from foot pain. Many conditions such as, for example, gout can cause pain so significant that the weight of bedding (i.e., sheets, blankets, etc.) on the feet can be unbearable. In effort to alleviate this pain, there are many devices intended to elevate bedding over feet.

U.S. Pat. No. 6,895,615 (Dilascio) discloses an in-bed tent frame designed to keep bedding off the toes of a person lying on his or her back on a standard bed. The frame includes a flat lower support frame which extends transversely across the bed between the mattress and box spring. The opposite ends of the lower support frame extend upward over the opposite sides of the mattress and connect to two hub assemblies. The two hub assemblies hold a support frame in a transversely aligned, elevated position over the mattress. Bedding placed over the upper support frame is then elevated over the user's feet when sleeping.

Although the device of U.S. Pat. No. 6,895,615 alleviates pain caused by the weight of bedding, there are disadvantages. For example, the in-bed tent frame of Dilascio provides no foot support. This is problematic for gout sufferers because joint movement is particularly painful. Another disadvantage is that the in-bed tent frame is inconvenient to use. That is, it has to be adjusted specifically to the size of the bed it is being used on. Furthermore, the mattress has to be lifted so that the flat lower support frame can be positioned between the bed spring and the mattress.

What is needed, therefore, is a device that protects feet from bedding and also provides foot support. What is also needed is a device that is more convenient to use.

SUMMARY

The present invention overcomes the problems associated with the prior art by providing a device that provides foot support and also protects feet from overhanging bedding.

The foot support includes a first sidewall, a second sidewall, a backwall, and a bottom surface. The first sidewall includes an interior surface disposed to engage the lateral side of a first foot of a user in a supine position. The second sidewall includes an interior surface disposed with respect to the first sidewall to engage the lateral side of a second foot of the user in the supine position. The backwall is disposed between the first sidewall and the second sidewall. The backwall includes an interior surface disposed to engage the plantar region of the first foot and the plantar region of the second foot of the user in said supine position. The bottom surface is coupled to the first sidewall, the second sidewall, and the backwall. Furthermore, the bottom surface is disposed to support the foot support device on a surface upon which the feet of the user are resting.

In an example embodiment, the foot support further comprises instructions to the user to position the feet of the user between the first sidewall and the second sidewall while in the supine position.

In another example embodiment, the first sidewall, the second sidewall, and the backwall are each a solid structure having a bottom surface. The bottom surfaces of the first sidewall, the second sidewall, and the backwall together form the bottom surface of the foot support device. In a more particular example, the bottom surface of the first sidewall, the bottom surface of the second sidewall, and the bottom surface of the backwall are coplanar.

In another example embodiment, the first sidewall, the second sidewall, and the backwall each include a hollow structure having a bottom edge. The bottom edges of the first sidewall, the second sidewall, and the backwall together form the bottom surface of the foot support device. In a more particular example, the bottom edges of the first sidewall, the second sidewall, and the backwall are coplanar.

In another example embodiment, the interior surface of the first sidewall faces toward the interior surface of the second sidewall and is inclined to face slightly upward to allow some abduction of one of said user's feet. Furthermore, the interior surface of the second sidewall faces toward the interior surface of the first sidewall and is inclined to face slightly upward to allow some abduction of the other of said user's feet. In a more particular example, the interior surface of the backwall is inclined to face slightly upward to allow some plantarflexion of the user's feet.

In yet another example embodiment, the first sidewall extends in a first direction, the second sidewall extends in a second direction, and the first direction and second direction are parallel. In a more particular example, the backwall extends in a third direction that is perpendicular to the first direction and the second direction.

In another particular example embodiment, the first sidewall, the second sidewall, and the backwall partially surround an open bottom region of the foot support device to allow the feet of the user to rest directly on the same surface that the foot support device rests on.

In another example embodiment, the first sidewall, the second sidewall, and the backwall are integral parts of a single body. In a more particular example, the foot support device is a foam structure. In an even more particular example, the foam structure is a molded foam structure. Alternatively, the foot support device can be a hollow polymeric structure.

In another example embodiment, the height of said first sidewall and said second sidewall is greater than the length of an adult human foot.

In yet another example embodiment, the foot support device is composed of a flexible and resilient material.

In yet another example embodiment, the foot support device includes a first discrete foot support and a second discrete foot support. The backwall includes a first region disposed on the first discrete foot support and a second region disposed on the second discrete foot support. The first sidewall is disposed on the first discrete foot support and the second sidewall is disposed on the second discrete foot support.

In another example embodiment, the foot support device further includes a removable cover.

In another example embodiment, the foot support device includes a first part and a separate second part. The backwall includes a first region disposed on the first part and a second region disposed on the second part. The first sidewall is disposed on the first part and the second sidewall is disposed on the second part. The first part and the second part adjustably engage one another to allow the distance between the first sidewall and second sidewall to be adjusted.

A method for manufacturing a foot support device is also disclosed. The method includes forming a first sidewall, forming a second sidewall, forming a backwall, forming a bottom surface, and coupling the first sidewall, the second sidewall, and the backwall to the bottom surface. The first sidewall includes an interior surface disposed to engage the lateral side of a first foot of a user in a supine position. The second sidewall includes an interior surface disposed to engage the lateral side of a second foot of the user in the supine position. The backwall is disposed between the first sidewall and the second sidewall. The backwall includes an interior surface disposed to engage the plantar region of the first foot of the user and the plantar region of the second foot of the user. The bottom surface is disposed to support the foot device on a surface upon which the feet of the user are resting.

In a particular example, the method further includes providing instructions to the user to position the feet of the user between the first sidewall and the second sidewall while in the supine position.

In a more particular example method, the step of forming the bottom surface includes forming the first sidewall, the second sidewall, and the backwall each as a solid structure having a bottom surface. The method further includes coupling the bottom surfaces of the first sidewall, the second sidewall, and the backwall together to form the bottom surface of the foot support device. In an even more particular example method, the steps of forming the bottom surface of the first sidewall, the bottom surface of the second sidewall, and the bottom surface of the backwall include forming the bottom surface of the first sidewall, the bottom surface of the second sidewall, and the bottom surface of the backwall to be coplanar.

In another particular example method, the steps of forming the first sidewall, the second sidewall, and the backwall include forming a hollow structure having a bottom edge. Furthermore, the step of forming the bottom surface of the foot support device includes forming the bottom edges of the first sidewall, the second sidewall, and the backwall. In a more particular example method, the steps of forming the bottom edges of the first sidewall, the second sidewall and the backwall include forming the bottom edges of the first sidewall, the second sidewall, and the backwall to be coplanar.

In another particular example method, the step of forming the first sidewall includes forming the interior surface of the first sidewall to face toward the interior surface of the second sidewall and to be inclined to face slightly upward to allow some abduction of one of the user's feet. Furthermore, the step of forming the second sidewall includes forming the interior surface of the second sidewall to face toward the interior surface of the first sidewall and to be inclined to face slightly upward to allow some abduction of the other of the user's feet. In an even more particular example, the step of forming the backwall includes forming the interior surface of the backwall to be inclined to face slightly upward to allow some plantarflexion of the user's feet.

In another particular example method, the step of forming the first sidewall includes forming the first sidewall to extend in a first direction and the step of forming the second sidewall includes forming the second sidewall to extend in a second direction parallel to the first direction. In a more particular example, the step of forming the backwall includes forming the backwall to extend in a third direction that is perpendicular to the first direction and the second direction.

In another particular example method, the steps of forming the first sidewall, the second sidewall, and the backwall include forming the first sidewall, the second sidewall, and the backwall to partially surround an open bottom region of the foot support device. This allows the feet of the user to rest directly on the same surface that the foot support device rests on.

In another particular example method, the steps of forming the first sidewall, the second sidewall, and the backwall include forming the first sidewall, the second sidewall, and the backwall into a single body. In a more particular example, the steps of forming the first sidewall, the second sidewall, and the backwall include forming a foam structure. In an even more particular example, the step of forming the foam structure includes molding the foam structure. In another more particular example, the steps of forming the first sidewall, the second sidewall, and the backwall include forming a hollow polymeric structure.

In another particular example method, the step of forming the first sidewall and the step of forming the second sidewall include forming the first sidewall and the second sidewall to have a height that is greater than the length of an adult human foot.

In another particular example, the method further comprises forming the foot support device from a flexible and resilient material.

In another particular example method, the step of forming the first sidewall includes forming a first discrete foot support. The step of forming the second sidewall includes forming a second discrete foot support. The step of forming the backwall includes forming a first region of the backwall on the first discrete foot support and a second region of the backwall on the second discrete foot support.

In yet another particular example, the method further includes providing a removable cover and disposing the first sidewall, the second sidewall, and the backwall in the removable cover.

In yet another particular example, the method further includes forming a first part of the foot support device and forming a second part of the foot support device. The step of forming the backwall includes forming a first region of the backwall on the first part and forming a second region of the backwall on the second part. The step of forming the first sidewall includes forming the first sidewall on the first part. The step of forming the second sidewall includes forming the second sidewall on the second part. Finally, the steps of forming the first part and the second part include forming the first part and the second part to adjustably engage one another.

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art, by providing a foot support device operative to provide foot support and provide protection from overhanging bedding. The foot support devices of the present invention can used universally with any type of bed, because the foot support rests on the top surface of the mattress of the bed. In the following description, numerous specific details are set forth (e.g. material types) in order to provide a thorough understanding of the invention. Those skilled in the art will recognize, however, that the invention may be practiced apart from these specific details. In other instances, details of well-known manufacturing practices (e.g. foam molding) and components have been omitted, so as not to unnecessarily obscure the present invention.

Figure 1:
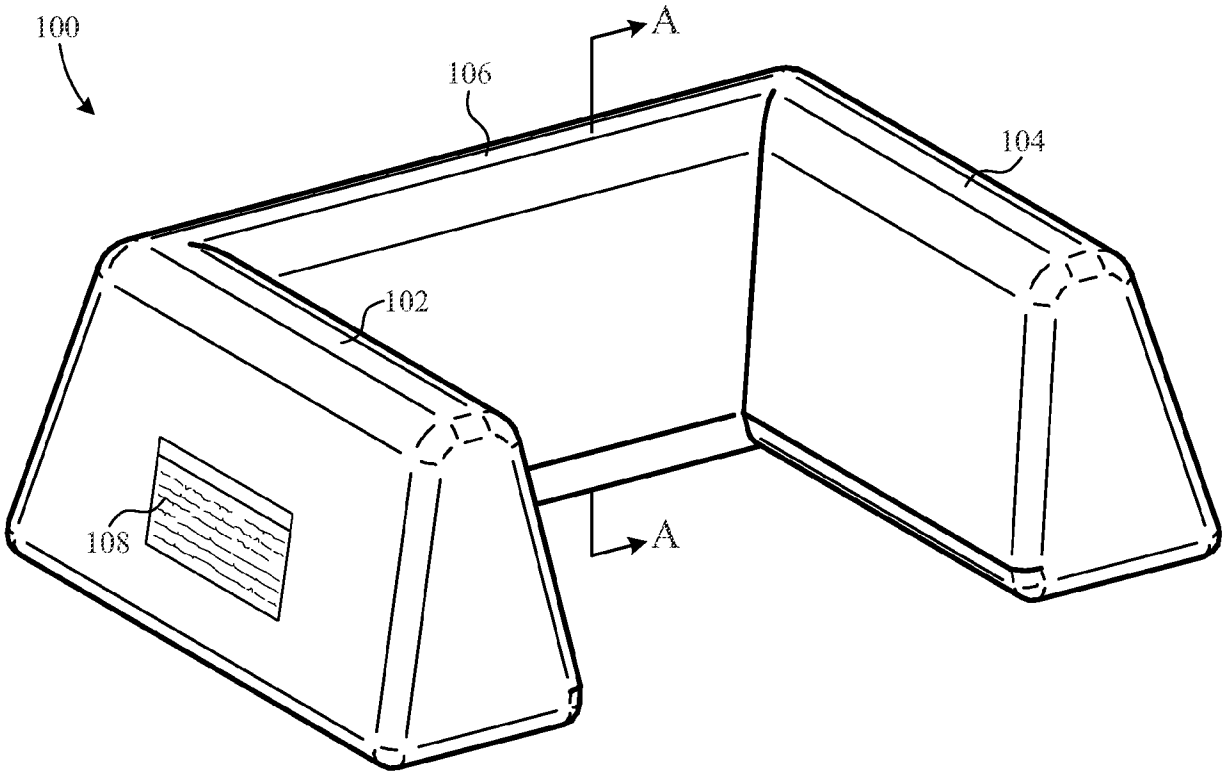
FIG. 1 is a perspective view of a foot support device.

FIG. 1 is a perspective view of a foot support device 100 according to one embodiment of the present invention. Foot support 100 is intended to alleviate pain associated with foot problems including, but not limited to, gout, burns, sprains, abrasions, broken bones, etc. Foot support 100 provides two main functions. One such function is to limit the motion of a user's feet. Another function is to protect the user's feet from contact with bedding (e.g., blankets, sheets, etc.) draped over the user's feet. In this particular embodiment, foot support 100 is formed, for example, by molding resilient foam into a single integral body. As shown, foot support includes a first sidewall 102 and a second sidewall 104 joined together by a backwall 106. Sidewall 102, sidewall 104 and backwall 106 define a volume for receiving the feet of a user, while the user is lying supine on the same surface upon which foot support device 100 is resting. The ends of sidewalls 102 and 104 define an opening through which the user's legs pass in order to position the feet within the volume defined by sidewalls 102 and 104 and backwall 106.

As used herein, the term "supine position" includes any sitting, lying, or reclined position, wherein the feet are positioned with the heels resting on a surface with the toes pointing upward. Examples of being in a supine position include, but are not limited to lying flat one one's back in a bed, lying in a reclined position in an adjustable bed, and sitting in a chair with one's feet resting on an ottoman.

Foot support device 100 further includes user instructions 108 attached thereto. In this particular embodiment, user instructions 108 is printed on a label attached to wall 102. User instructions 108 include text instructing the user to place foot support device 100 on a suitable surface (e.g., mattress, sofa cushion, etc.) position the user's feet within foot support device 100, and pull any bedding being used (e.g., sheet, blanket, etc.) over foot support device 100. In placing feet in foot support device 100, the user is instructed to position the plantar regions of both feet close to or against wall 106 such that the outside of the left and right foot are supported by walls 102 and 104, respectively.

Although user instructions 108 are depicted as being text printed on a label that is permanently attached to foot support device 100, it should be understood that user instructions 108 can be presented to the user in any effective form. For example, the text of user instructions 108 can be printed or molded directly on foot support device 100. Alternatively, user instructions 108 could be separate from foot support device 100 on, for example, a user instructions sheet that is placed in the packaging of foot support device 100 by the manufacturer. As yet another example, user instructions can be communicated orally to a user by, for example, a health care assistant.

Figure 2:
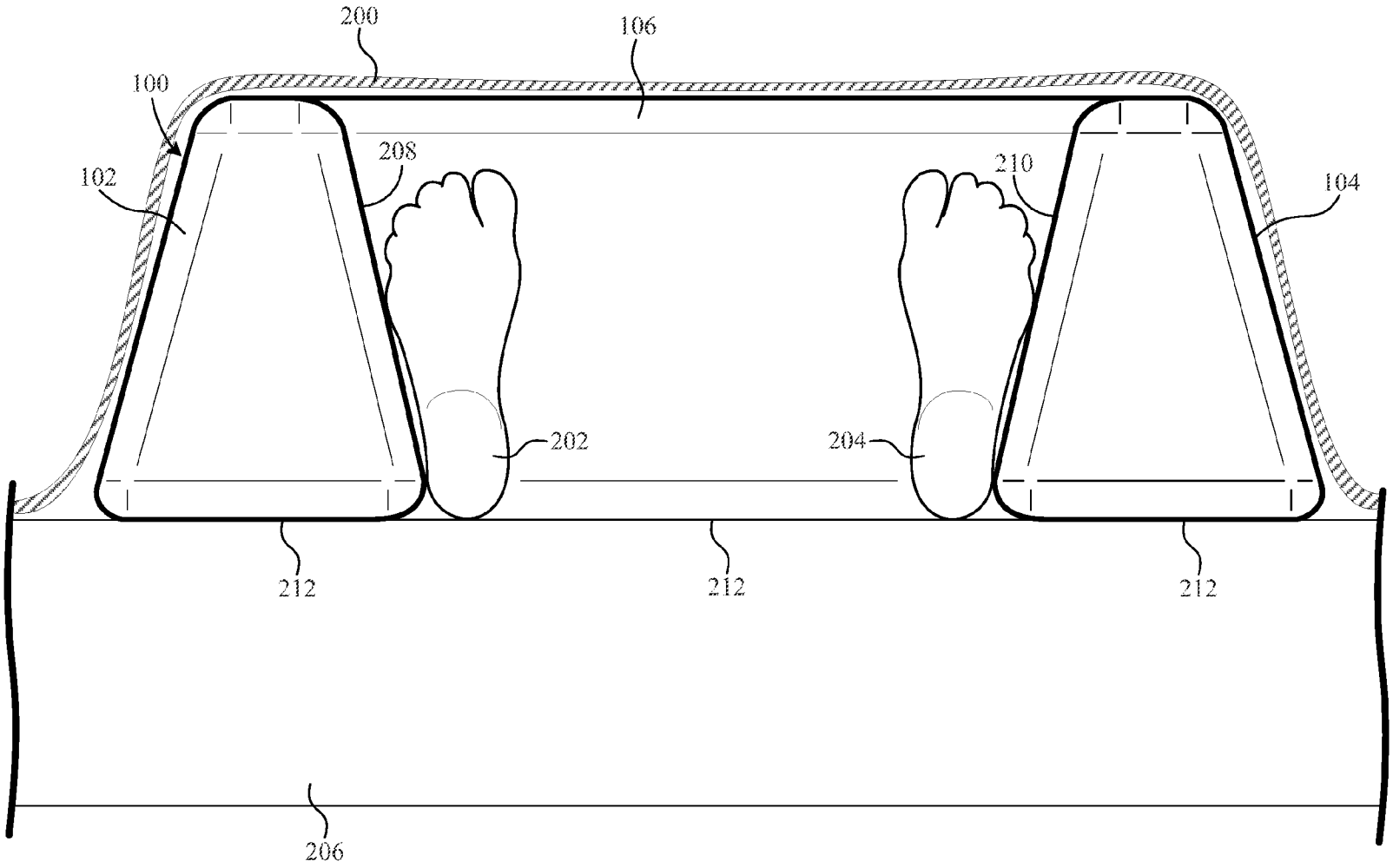
FIG. 2 is a front view of the foot support device of FIG. 1.

FIG. 2 is a front view of foot support device 100 shown suspending a bed sheet 200 over the left foot 202 and the right foot 204 of a user lying on a mattress 206. As shown, the height of sidewall 102, sidewall 104, and backwall 106 is sufficiently greater than the lengths of a user's feet 202 and 204. This prevents bed sheet 200 from draping down and contacting feet 202 and 204.

The average length of an adult human foot is about 11 inches, and one of the longest human feet ever recorded was about 18 inches. Therefore, making sidewalls 102 and 104 and backwall 106 at least 18 inches high would be sufficient for virtually all users. However, foot support devices of various heights can be provided, so that each user can obtain a foot support device of an appropriate size, thereby avoiding unnecessary height.

In addition to preventing bed sheet 200 from contacting feet 202 and 204, foot support 100 also minimizes pain by supporting feet 202 and 204. That is, sidewall 102 includes an interior surface 208 that supports foot 202 and sidewall 104 includes an interior surface 210 that supports foot 204. Interior surface 208 is slightly inclined so as to comfortably engage the lateral side of foot 202. With the lateral side of foot 202 engaged by interior surface 208, excessive abduction (e.g., outward rotation) of foot 202 is prevented. Likewise, interior surface 210 is slightly inclined so as to comfortably engage the lateral side of foot 204. Again, with the lateral side of foot 204 engaged by interior surface 210, excessive abduction of foot 204 is prevented.

Foot support 100 also includes a bottom surface 212 that is adapted to rest on any desirable surface such as, for example, the top of mattress 206. Unlike many prior art devices, the operation of foot support 100 does not depend on the object or surface it rests on. Instead, foot support 100 is adapted for use almost anywhere, including, but not limited to, a bed, a gurney, a sofa, a floor, an ottoman, etc.

Figure 3:
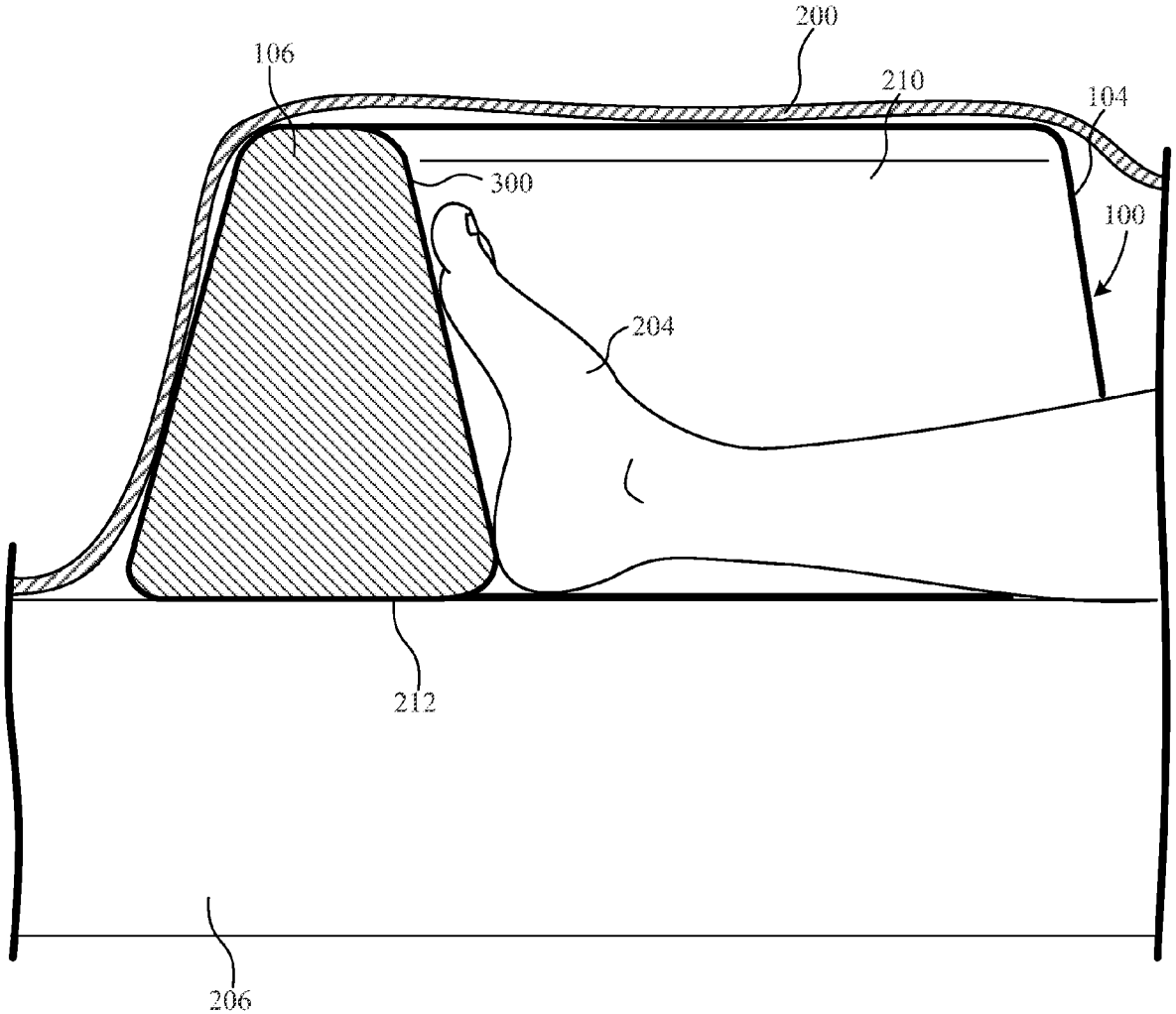
FIG. 3 is a cross sectional side view of the foot support device of FIG. 1.

FIG. 3 is a cross-sectional view of foot support 100 taken along line A-A of FIG. 1. Backwall 106 supports both the left foot 202 and the right foot 204 (only right foot 204 shown). More specifically, backwall 106 includes an interior surface 300 that is adapted to engage the plantar regions of both feet 202 and 204 simultaneously. As shown, interior surface 300 is slightly inclined so as to prevent excessive plantarflexion of feet 202 and 204.

Figure 4:
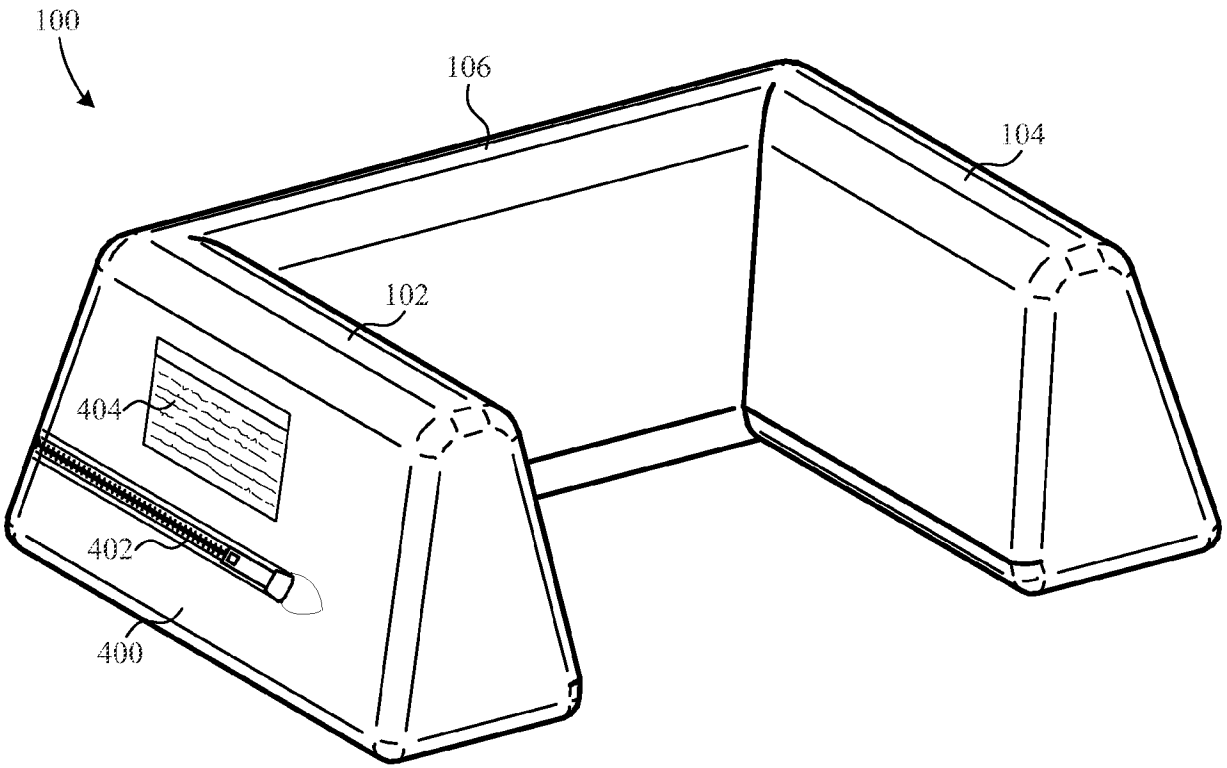
FIG. 4 is a perspective view of the foot support device of FIG. 1 disposed in a cover.

FIG. 4 shows a perspective view of foot support 100 disposed within a removable cover 400. In this example, cover 400 includes a zipper 402 to facilitate the securing of cover 400 onto foot support 100. However, those skilled in the art will recognize that cover 400 could include any suitable fastening device (e.g., hook and loop fastener, snap fasteners, etc.) to secure cover 400 onto foot support 100. Although not necessary, either foot support 100 and/or cover 400 could be formed from hypoallergenic materials (e.g., latex-free fabrics, latex free foams, etc.).

In this particular embodiment, cover 400 includes user instructions 404 which, in the example embodiment, are in the form of a label attached to cover 400 by some suitable means such as, for example, stitching, adhesive, etc. Like user instructions 108, user instructions 404 can be presented to the user in any of several various forms including, but not limited to, text printed on cover 400, a label attached to cover 400, a separate sheet of paper having user instructions printed thereon, orally, etc.

Figure 5:
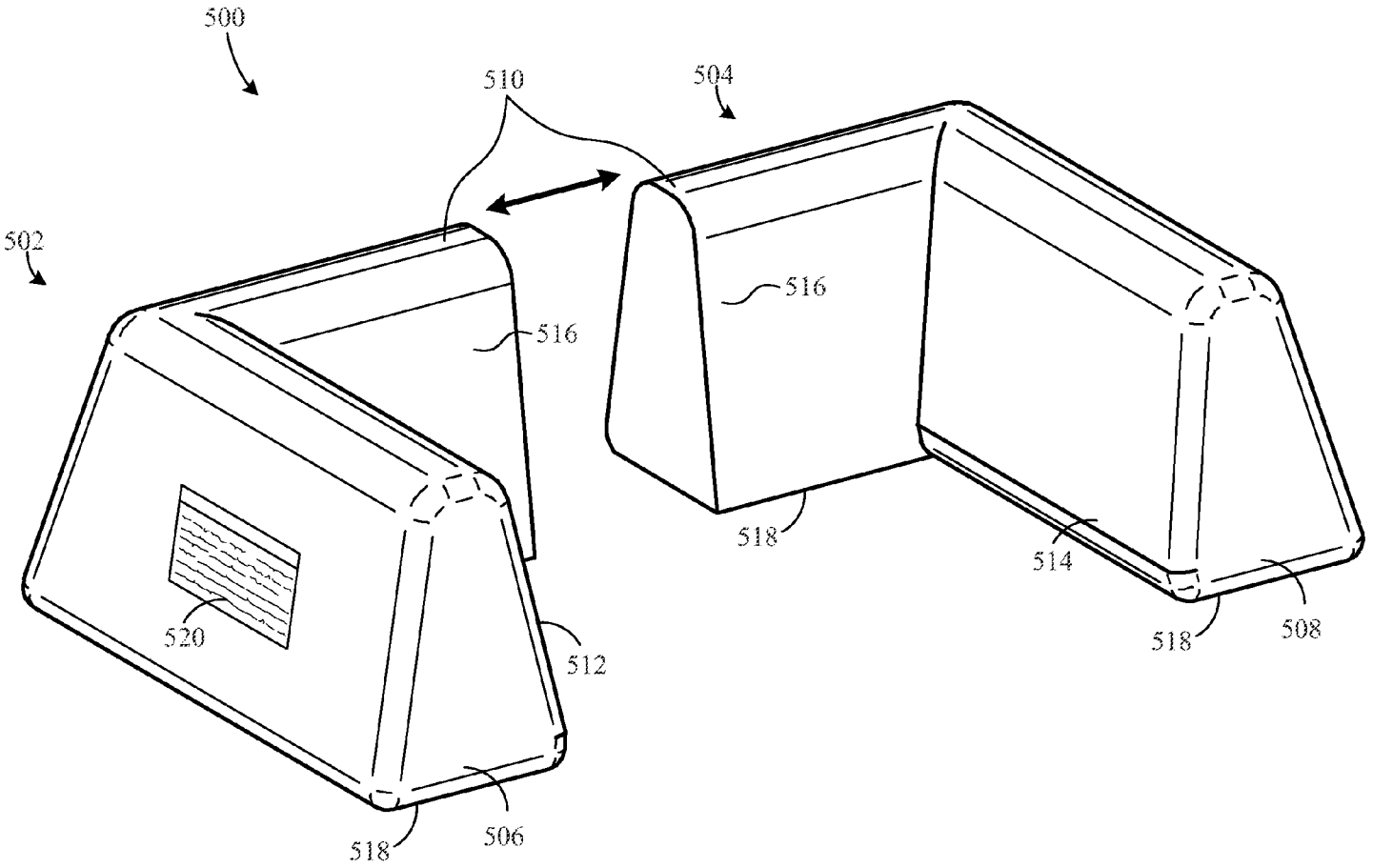
FIG. 5 is a perspective view of an alternate foot support device.

FIG. 5 shows a perspective view of a foot support 500 according to an alternate embodiment of the present invention. In this particular embodiment, foot support 500 is substantially similar to foot support 100 except that foot support 500 is formed from two discrete parts 502 and 504. Because foot support 500 is made up of two discrete parts 502 and 504, it can be adjusted to any desirable width simply by moving parts 502 and 504 toward or away from one another according to user preference. Parts 502 and 504 are operative to support the left and right feet, respectively, of a user. Furthermore, parts 502 and 504 are operative to, together, prevent bedding from contacting the feet of a user.

Foot support 500 includes a first sidewall 506 and a second sidewall 508 connected to opposite sides of a split backwall 510. First sidewall 506 includes an interior surface 512 that is adapted to engage the lateral side of a left foot. As shown, interior surface 512 is inclined so as to prevent excessive abduction of a user's left foot. Second sidewall 508 also includes an interior surface 514 that is adapted to engage the lateral side of a right foot. As shown, interior surface 514 is inclined so as to prevent excessive abduction of a user's right foot. Backwall 510 includes an interior surface 516 that is adapted to engage the plantar region of both the left and right foot of the user. Interior surface 516 is also inclined so as to prevent excessive plantarflexion of both the user's left and right foot. Foot support 500 also includes a bottom surface 518 that is adapted to rest on any desirable surface such as, for example, the top of a mattress.

In this particular embodiment, foot support 500 includes user instructions 520 which, in the example embodiment, are in the form of a label attached the outside of part 502 by some suitable means such as, for example, stitching, adhesive, etc. Like user instructions 108 and 404, user instructions 520 can be presented to the user in various forms including, but not limited to, text printed on part 502, a label attached to part 502, a separate sheet of paper having user instructions printed thereon, orally, etc.

Figure 6:
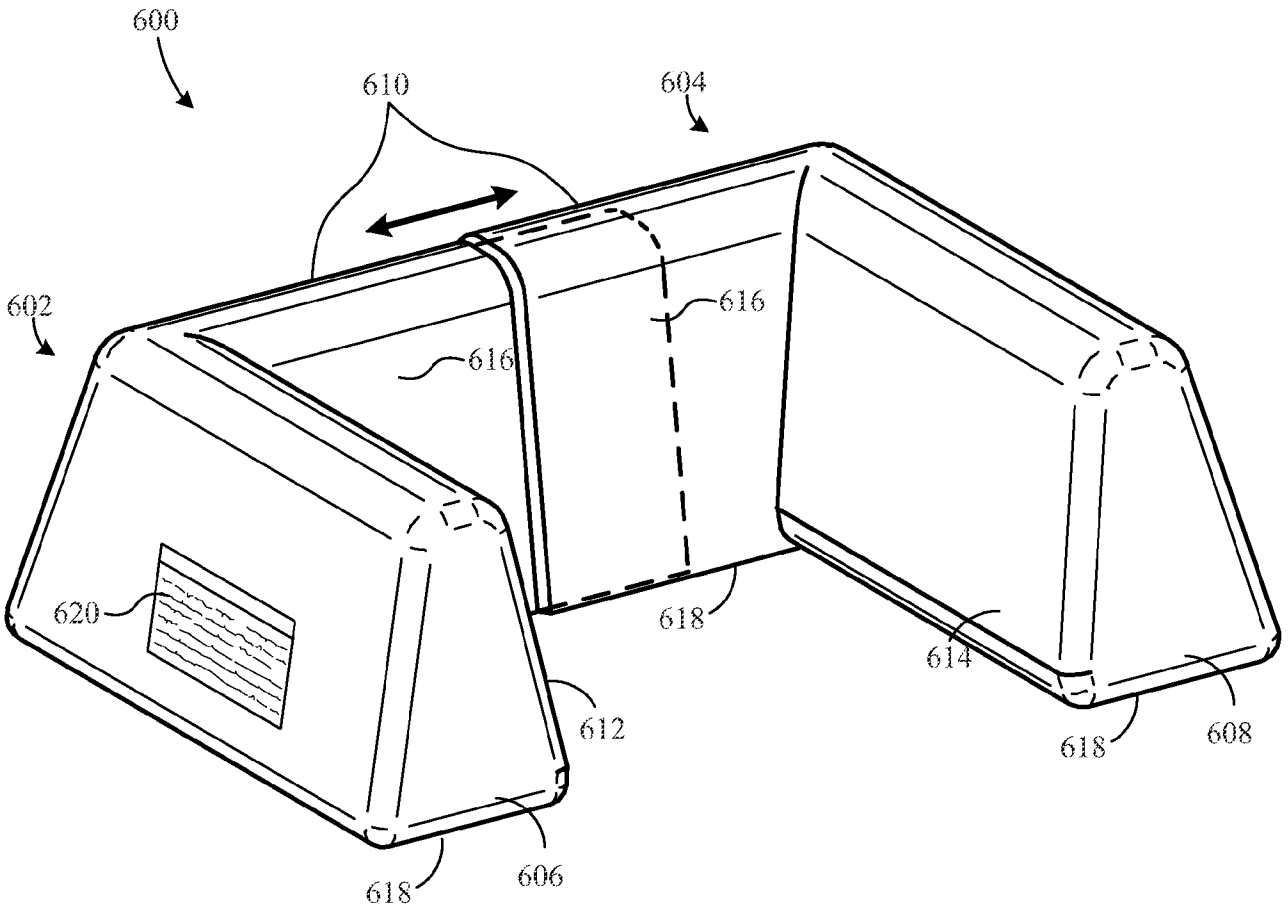
FIG. 6 is a perspective view of another alternate foot support device.

FIG. 6 shows a perspective view of a foot support device 600 according to an alternate embodiment of the present invention. In this particular embodiment, foot support device 600 is substantially similar to foot support device 500 except that foot support device 600 is formed from two discrete parts 602 and 604 that are slidably coupled to one another in a telescoping fashion. Because foot support device 600 is made up of two discrete telescoping parts 602 and 604, it can be adjusted to any desirable width simply by moving part 602 into and out of part 604 according to user preference and/or medical advice. Optionally, a fastening mechanism (not shown) can be provided to maintain parts 602 and 604 in place with respect to one another after they are properly adjusted. Examples of suitable fastening mechanisms include, but are not limited to, complementary engaging structures or a frictional fit between parts 602 and 604. Parts 602 and 604 are operative together to support the left and right feet of a user and to prevent bedding from contacting the user's feet.

Foot support device 600 includes a first sidewall 606 and a second sidewall 608 connected to opposite sides of a telescoping backwall 610. First sidewall 606 includes an interior surface 612 that is adapted to engage the lateral side of a left foot. As shown, interior surface 612 is inclined slightly, to support the user's foot in a comfortable position, yet prevent excessive abduction of the user's left foot. Second sidewall 608 also includes an interior surface 614 that is adapted to engage the lateral side of a right foot. As shown, interior surface 614 is inclined slightly to support the user's right foot in a comfortable position, yet prevent excessive abduction of the user's right foot. Backwall 610 includes an interior surface 616 that is adapted to engage the plantar region of both the left and right foot of the user. Interior surface 616 is also inclined to allow some, but prevent excessive, plantarflexion of both the user's left and right foot. Foot support device 600 also includes a bottom surface 618 that is adapted to rest on any desirable surface such as, for example, the top of a mattress.

In this particular embodiment, part 602 and part 604 are hollow, thin-walled structures. The bottom of parts 602 and 604 (not shown) can be either open or closed. In either case, the bottom of parts 602 and 604 provide a surface for supporting foot support device 600. In the case of an open bottom, the lower edges of sidewalls 606 and 608 and backwall 610 form bottom surface 618. In the case of a closed bottom, a surface joining the lower edges of sidewalls 606 and 608 and backwall 610 form bottom surface 618.

In this particular embodiment, foot support 600 includes user instructions 620 which, in the example embodiment, are in the form of a label attached the outside of part 602 by some suitable means such as, for example, stitching, adhesive, etc. Like user instructions 108, 404, and 520, user instructions 620 can be presented to the user in various forms including, but not limited to, text printed or molded on part 602, a label attached to part 602, a separate sheet of paper having user instructions printed thereon, orally, etc.

Figure 7:
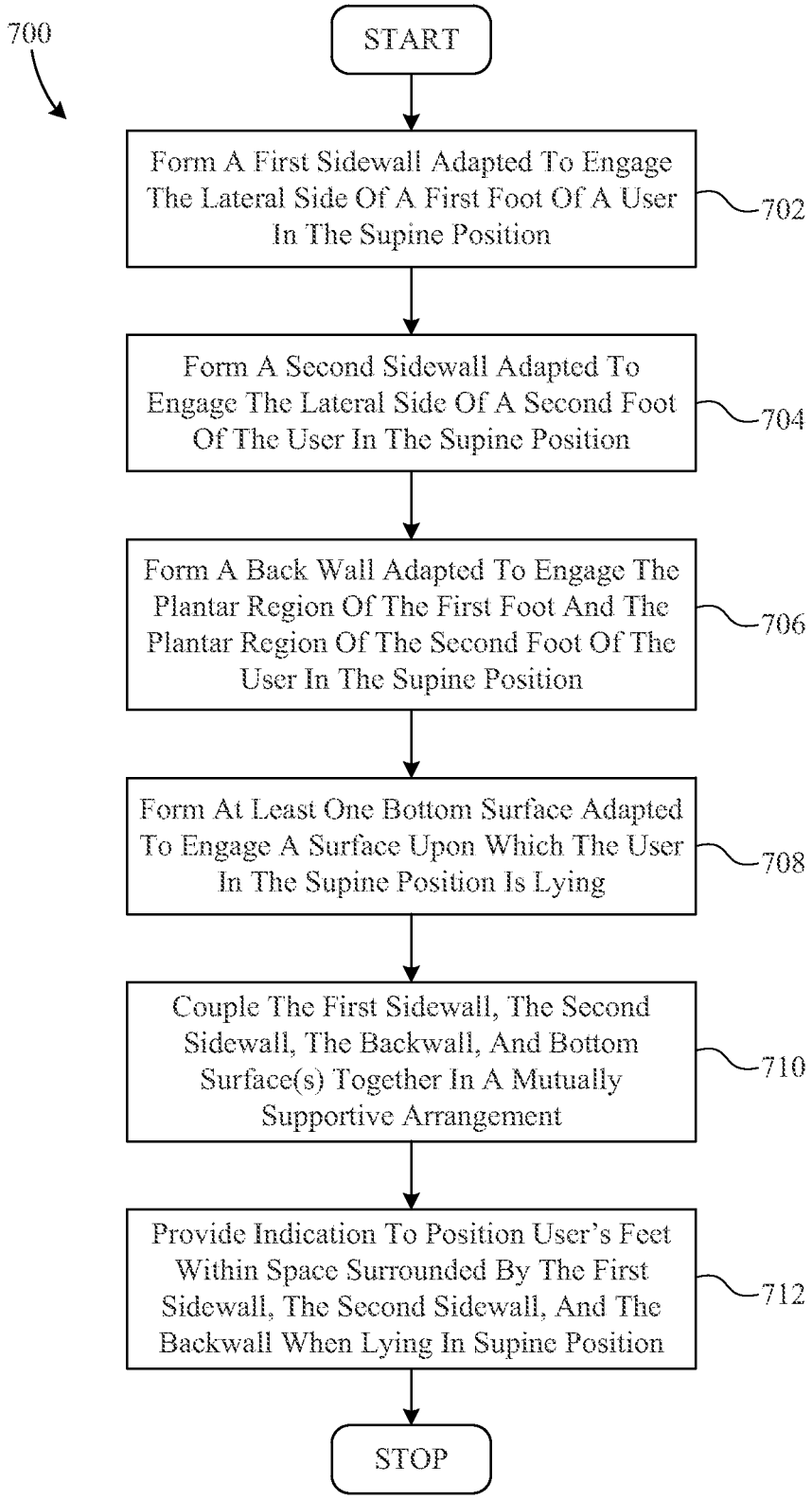
FIG. 7 is a flow chart summarizing a method for manufacturing a foot support device.

FIG. 7 is a flow chart summarizing one method 700 of manufacturing a foot support device. In a first step 702, a first sidewall adapted to engage the lateral side of a first foot of a user in a supine position is formed. Then, in a second step 704, a second sidewall adapted to engage the lateral side of a second foot of the user in a supine position is formed. Next, in a third step 706, a backwall adapted to engage the plantar region of the first foot and the plantar region of the second foot of the user in the supine position is formed. Then, in a fourth step 708, at least one bottom surface adapted to engage a surface upon which the user in the supine position is lying is formed. Next, in a fifth step 710, the first sidewall, the second sidewall, the backwall, and the bottom surface(s) are coupled together in a mutually supportive arrangement. Finally, in a sixth step 712, an indication is provided to position the feet of the user within the space surrounded by the first sidewall, the second sidewall, and the backwall when the user is lying in the supine position.

The description of particular embodiments of the present invention is now complete. Many of the described features may be substituted, altered or omitted without departing from the scope of the invention. For example, alternate materials (e.g., cotton, memory foam, etc.), may be substituted for the foam used to form foot supports 100 and 500. As another example, alternate methods (e.g. cutting a foam block into shape) of manufacturing foot supports 100 and 500 may be substituted for the method of molding foot supports 100 and 500. As yet another example, foot support 100 and/or foot support 500 can also be inflatable structures. These and other deviations from the particular embodiments shown will be apparent to those skilled in the art, particularly in view of the foregoing disclosure.

I claim:

1. A foot support device comprising:

a first sidewall having an interior surface disposed to engage the lateral side of a first foot of a user in a supine position;

a second sidewall having an interior surface disposed with respect to said first sidewall to engage the lateral side of a second foot of said user in the supine position;

a backwall disposed between said first sidewall and said second sidewall, said first sidewall and said second sidewall extending away from said backwall, said backwall having an interior surface disposed to engage the plantar region of said first foot and the plantar region of said second foot of said user in said supine position; and a bottom surface coupled to said first sidewall, said second sidewall, and said backwall, and disposed to support said foot support device on a surface upon which said feet of said user are resting; and wherein said interior surface of said first sidewall faces toward said interior surface of said second sidewall and is inclined, wherein the incline extending between the bottom and top surface of the first sidewall faces slightly upward to allow some abduction of one of said user's feet; and said interior surface of said second sidewall faces toward said interior surface of said first sidewall and is inclined, wherein the incline extending between the bottom and top surface of the second sidewall faces slightly upward to allow some abduction of the other of said user's feet.

2. The foot support device of claim 1, further comprising instructions to said user to position said feet of said user between said first sidewall and said second sidewall while in said supine position.

3. The foot support device of claim 1, wherein:

said first sidewall, said second sidewall, and said backwall are each a solid structure having a bottom surface; and said bottom surfaces of said first sidewall, said second sidewall, and said backwall together form said bottom surface of said foot support device.

4. The foot support device of claim 3, wherein said bottom surface of said first sidewall, said bottom surface of said second sidewall, and said bottom surface of said backwall are coplanar.

5. The foot support device of claim 1, wherein:

said first sidewall, said second sidewall, and said backwall each include a hollow structure having a bottom edge; and said bottom edges of said first sidewall, said second sidewall, and said backwall together form said bottom surface of said foot support device.

6. The foot support device of claim 5, wherein said bottom edges of said first sidewall, said second sidewall, and said backwall are coplanar.

7. The foot support device of claim 1, wherein said interior surface of said backwall is inclined to face slightly upward to allow some plantarflexion of said user's feet.

8. The foot support device of claim 1, wherein:

said first sidewall extends in a first direction;

said second sidewall extends in a second direction; and said first direction and said second direction are parallel.

9. The foot support device of claim 8, wherein said backwall extends in a third direction, said third direction being perpendicular to said first direction and said second direction.

10. The foot support device of claim 1, wherein said first sidewall, said second sidewall, and said backwall partially surround an open bottom region of said foot support device to allow said feet of said user to rest directly on the same surface that said foot support device rests on.

11. The foot support device of claim 1, wherein said first sidewall, said second sidewall, and said backwall are integral parts of a single body.

12. The foot support device of claim 11, wherein said foot support device is a foam structure.

13. The foot support device of claim 12, wherein said foam structure is a molded foam structure.

14. The foot support device of claim 11, wherein said foot support device is a hollow polymeric structure.

15. The foot support device of claim 1, wherein the height of said first sidewall and said second sidewall is greater than the length of an adult human foot.

16. The foot support device of claim 1, wherein said foot support device is flexible and resilient.

17. The foot support device of claim 1, wherein:

said foot support device includes a first discrete foot support and a second discrete foot support;

said backwall includes a first region disposed on said first discrete foot support and a second region disposed on said second discrete foot support;

said first sidewall is disposed on said first discrete foot support; and said second sidewall is disposed on said second discrete foot support.

18. The foot support device of claim 1, further comprising a removable cover.

19. The foot support device of claim 1, wherein:

said foot support device includes a first part and a separate second part;

said backwall includes a first region disposed on said first part and a second region disposed on said second part;

said first sidewall is disposed on said first part;

said second sidewall is disposed on said second part; and said first part and said second part adjustably engage one another.

20. The foot support device of claim 1, wherein:

said first sidewall includes a bottom surface;

said second sidewall includes a bottom surface;

said backwall includes a bottom surface;

said bottom surface of said first sidewall, said bottom surface of said second sidewall, and said bottom surface of said backwall are coplanar and together form said bottom surface of said foot support device;

said interior surface of said backwall is inclined to face slightly upward;

said first sidewall extends in a first direction;

said second sidewall extends in a second direction;

said first direction and said second direction are parallel to one another;

said backwall extends in a third direction;

said third direction is perpendicular to said first direction and said second direction;

said first sidewall, said second sidewall, and said backwall partially surround an open bottom region of said foot support device; and said first sidewall, said second sidewall, and said backwall are integral parts of a single body.

21. A method for manufacturing a foot support device, said method comprising:

forming a first sidewall having an interior surface disposed to engage the lateral side of a first foot of a user in a supine position;

forming a second sidewall having an interior surface disposed to engage the lateral side of a second foot of said user in said supine position;

forming a backwall disposed between said first sidewall and said second sidewall, said first sidewall and said second sidewall extending away from said backwall, said backwall having an interior surface disposed to engage the plantar region of said first foot of said user and the plantar region of said second foot of said user;

forming a bottom surface disposed to support said foot device on a surface upon which said feet of said user are resting; and coupling said first sidewall, said second sidewall, and said backwall to said bottom surface; and wherein said step of forming said first sidewall includes forming said interior surface of said first sidewall to face toward said interior surface of said second sidewall and to be inclined wherein the incline extending between the bottom and top surface of the first sidewall faces slightly upward to allow some abduction of one of said user's feet, and said step of forming said second sidewall includes forming said interior surface of said second sidewall to face toward said interior surface of said first sidewall and to be inclined, wherein the incline extending between the bottom and top surface of the second sidewall faces slightly upward to allow some abduction of the other of said user's feet.

22. The method of claim 21, further comprising providing instructions to said user to position said feet of said user between said first sidewall and said second sidewall while in said supine position.

23. The method of claim 21, wherein said step of forming said bottom surface includes:

forming said first sidewall, said second sidewall, and said backwall each as a solid structure having a bottom surface; and coupling said bottom surfaces of said first sidewall, said second sidewall, and said backwall together to form said bottom surface of said foot support device.

24. The method of claim 23, wherein said steps of forming said bottom surface of said first sidewall, said bottom surface of said second sidewall, and said bottom surface of said backwall include forming said bottom surface of said first sidewall, said bottom surface of said second sidewall, and said bottom surface of said backwall to be coplanar.

25. The method of claim 21, wherein:

said steps of forming said first sidewall, said second sidewall, and said backwall include forming a hollow structure having a bottom edge; and said step of forming said bottom surface of said foot support device includes forming said bottom edges of said first sidewall, said second sidewall, and said backwall.

26. The method of claim 25, wherein said step of forming said bottom edges of said first sidewall, said second sidewall, and said backwall includes forming said bottom edges of said first sidewall, said second sidewall, and said backwall to be coplanar.

27. The method of claim 21, wherein said step of forming said backwall includes forming said interior surface of said backwall to be inclined to face slightly upward to allow some plantarflexion of said user's feet.

28. The method of claim 21, wherein:

said step of forming said first sidewall includes forming said first sidewall to extend in a first direction; and said step of forming said second sidewall includes forming said second sidewall to extend in a second direction parallel to said first direction.

29. The method of claim 28, wherein said step of forming said backwall includes forming said backwall to extend in a third direction perpendicular to said first direction and said second direction.

30. The method of claim 21, wherein said steps of forming said first sidewall, forming said second sidewall, and forming said backwall include forming said first sidewall, said second sidewall, and said backwall to partially surround an open bottom region of said foot support device to allow said feet of said user to rest directly on the same surface that said foot support device rests on.

31. The method of claim 21, wherein said steps of forming said first sidewall, forming said second sidewall, and forming said backwall include forming said first sidewall, said second sidewall, and said backwall to be integral parts of a single body.

32. The method of claim 31, wherein said step of forming said first sidewall, forming said second sidewall, and forming said backwall include forming a foam structure.

33. The method of claim 32, wherein said step of forming said foam structure includes molding said foam structure.

34. The method of claim 31, wherein said steps of forming said first sidewall, forming said second sidewall, and forming said backwall include forming a hollow polymeric structure.

35. The method of claim 21, wherein said step of forming said first sidewall and said step forming said second sidewall include forming said first sidewall and said second sidewall to have a height that is greater than the length of an adult human foot.

36. The method of claim 21, further comprising forming said foot support device from a flexible and resilient material.

37. The method of claim 21, wherein:

said step of forming said first sidewall includes forming a first discrete foot support;

said step of forming said second sidewall includes forming a second discrete foot support; and said step of forming said backwall includes forming a first region of said backwall on said first discrete foot support and forming a second region of said backwall on said second discrete foot support.

38. The method of claim 21, further comprising providing a removable cover adapted to be disposed over said first sidewall, said second sidewall, and said backwall.

39. The method of claim 21, further comprising:

forming a first part of said foot support device;

forming a second part of said foot support device; and wherein said step of forming said backwall includes forming a first region of said backwall on said first part and forming a second region of said backwall on said second part;

said step of forming said first sidewall includes forming said first sidewall on said first part;

said step of forming said second sidewall includes forming said second sidewall on said second part; and wherein said step of forming said first part and said second part includes forming said first part and said second part to adjustably engage one another.

40. The foot support device of claim 21, wherein:

said step of forming said first sidewall includes forming a bottom surface;

said step of forming said second sidewall includes forming a bottom surface;

said step of forming said backwall includes forming a bottom surface;

said steps of forming said bottom surface of said first sidewall, forming said bottom surface of said second sidewall, and forming said bottom surface of said backwall include forming said bottom surface of said first sidewall, said bottom surface of said second sidewall, and said bottom surface of said backwall to be coplanar and to, together, form said bottom surface of said foot support device;

said step of forming said backwall includes forming said interior surface of said backwall to be inclined to face slightly upward;

said step of forming said first sidewall includes forming said first sidewall to extend in a first direction;

said step of forming said second sidewall includes forming said second sidewall to extend in a second direction parallel to said first direction;

said step of forming said backwall includes forming said backwall to extend in a third direction perpendicular to said first direction and said second direction;

said steps of forming said first sidewall, forming said second sidewall, and forming said backwall includes forming said first sidewall, said second sidewall, and said backwall to partially surround an open bottom region of said foot support device; and said step of forming said first sidewall, forming said second sidewall, and forming said backwall include forming said first sidewall, said second sidewall, and said back-wall as integral parts of a single body.

* * * * *